US008247146B2

(12) United States Patent
Mang et al.

(10) Patent No.: US 8,247,146 B2
(45) Date of Patent: Aug. 21, 2012

(54) TONERS WITH REDUCED PLASTICIZATION AND BLOCKING QUALITIES

(75) Inventors: Mark E. Mang, Rochester, NY (US); Eugene F. Young, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/898,614

(22) Filed: Oct. 5, 2010

(65) Prior Publication Data

US 2011/0020744 A1 Jan. 27, 2011

Related U.S. Application Data

(62) Division of application No. 11/731,842, filed on Mar. 30, 2007, now Pat. No. 7,833,688.

(51) Int. Cl.
*G03G 9/08* (2006.01)

(52) U.S. Cl. ..... 430/108.4; 430/109.4; 430/111.4

(58) Field of Classification Search ..... 430/111.4, 430/108.4, 109.4
See application file for complete search history.

(56) References Cited

U.S. PATENT DOCUMENTS

| | | | | |
|---|---|---|---|---|
| 5,556,727 | A | 9/1996 | Ciccarelli et al. | |
| 6,326,119 | B1 | 12/2001 | Hollenbaugh, Jr. et al. | |
| 6,359,105 | B1 | 3/2002 | Ianni et al. | |
| 6,365,316 | B1 | 4/2002 | Stamp et al. | |
| 6,824,942 | B2 | 11/2004 | Silence et al. | |
| 6,835,768 | B2 | 12/2004 | Agur et al. | |
| 6,850,725 | B2 | 2/2005 | Silence et al. | |
| 7,160,661 | B2 | 1/2007 | Moffat et al. | |
| 7,179,575 | B2 | 2/2007 | Moffat et al. | |
| 2004/0022562 | A1 | 2/2004 | Nakamura et al. | |
| 2006/0088779 | A1 | 4/2006 | Sacripante et al. | |
| 2006/0228639 | A1 | 10/2006 | Young et al. | |
| 2007/0141498 | A1 | 6/2007 | Umehara | |
| 2007/0207401 | A1 | 9/2007 | Shirai | |
| 2007/0248902 | A1 | 10/2007 | Asarese et al. | |
| 2008/0166647 | A1 * | 7/2008 | Mang et al. | 430/108.4 |

FOREIGN PATENT DOCUMENTS

| | | | |
|---|---|---|---|
| JP | 2002328490 | A | 11/2002 |
| WO | WO 2005103833 | A1 | 11/2005 |

OTHER PUBLICATIONS

English language machine translation of JP 2002-328490 (Nov. 2002).

* cited by examiner

*Primary Examiner* — Christopher Rodee
(74) *Attorney, Agent, or Firm* — Pillsbury Winthrop Shaw Pittman LLP

(57) ABSTRACT

Use of a wax in a toner, such as carnauba wax, to give an increase in charge control agent in a toner, such as a magenta toner, to give an increased glass transition temperature is disclosed. The toner may contain a resin comprising amorphous and crystalline polyesters to provide good low melt characteristics.

18 Claims, No Drawings

TONERS WITH REDUCED PLASTICIZATION AND BLOCKING QUALITIES

RELATED APPLICATIONS

This application is a divisional application of U.S. patent application Ser. No. 11/731,842 now U.S. Pat. 7,833,688, filed Mar. 30, 2007, which is expressly incorporated herein by reference in its entirety.

TECHNICAL FIELD

The presently disclosed embodiments are generally directed to methods for reducing plasticization and blocking in toner compositions and toners with reduced plasticization and blocking qualities. More specifically, the present embodiments relate to methods that involve the incorporation of carnauba wax into toner compositions to increase the glass transition temperature (Tg) in toners, and such resulting toners. Such toners exhibit a desirable combination of characteristics, such as being a low melt toner to reduce toner build up and having increased Tg so that plasticization and blocking is avoided.

BACKGROUND

Electrophotography, which is a method for visualizing image information by forming an electrostatic latent image, is currently employed in various fields. The term "electrostatographic" is generally used interchangeably with the term "electrophotographic." In general, electrophotography comprises the formation of an electrostatic latent image on a photoreceptor, followed by development of the image with a developer containing a toner, and subsequent transfer of the image onto a transfer material such as paper or a sheet, and fixing the image on the transfer material by utilizing heat, a solvent, pressure and/or the like to obtain a permanent image.

Toner utilized in development in the electrographic process is generally prepared by mixing and dispersing a colorant and a charge enhancing additive into a thermoplastic binder resin, followed by micropulverization. As the thermoplastic binder resin, several polymers are known, including polystyrenes, styrene-acrylic resins, styrene-methacrylic resins, polyesters, epoxy resins, acrylics, urethanes and copolymers thereof. As the colorant, carbon black is utilized often, and as the charge enhancing additive, alkyl pyridinium halides, distearyl dimethyl ammonium methyl sulfate, and the like are known.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrophotographic imaging members may include photosensitive members (photoreceptors) which are commonly utilized in electrophotographic (xerographic) processes, in either a flexible belt or a rigid drum configuration. Other members may include flexible intermediate transfer belts that are seamless or seamed, and usually formed by cutting a rectangular sheet from a web, overlapping opposite ends, and welding the overlapped ends together to form a welded seam. These electrophotographic imaging members comprise a photoconductive layer comprising a single layer or composite layers.

Common wear and tear problems lead to short fuser life. One method used to alleviate this problem was to lower the roller temperature. It was discovered that combinations of amorphous and crystalline polyesters used in toner compositions could lower the fusing temperature of the rollers. However, the addition of crystalline polyester to amorphous polyester also results in a suppression of the glass transition temperature (Tg) of the toner, or "plasticization." Plasticization is undesirable and leads to storage problems at high temperatures, also known as "blocking." In blocking, the toner particles begin to melt or sinter and thus partially fuse together.

Thus, there is a need in the art for a toner, and method for making the same, that is both a low melt toner (to reduce temperature and wear on the fuser roll) and one that substantially avoids the problems of plasticization or blocking.

BRIEF SUMMARY

According to embodiments illustrated herein, there is provided methods for reducing plasticization and blocking in toner compositions and toners with reduced plasticization and blocking qualities that address the shortcomings discussed above.

An embodiment may include a method for reducing toner plasticization in a toner, comprising forming a toner composition by mixing a resin and a colorant, the resin comprising a mixture of crystalline polyester resin and amorphous polyester resin, adding and mixing a functional wax (such as carnauba) into the toner composition to increase dispersion of the crystalline polyester resin and the amorphous polyester resin, wherein the wax comprises carnauba wax and the mixing is accomplished in an extruder at a temperature of from about 80° C. to about 120° C.; and grinding and classifying the toner composition to form a toner having a higher glass transition temperature than a toner without the carnauba wax.

In another embodiment, there is provided a method for reducing toner plasticization in a toner, comprising forming a toner composition by mixing a resin and a colorant, the resin comprising a dispersion of crystalline polyester resin and amorphous polyester resin, adding and mixing carnauba wax into the toner composition to increase dispersion of the crystalline polyester resin and the amorphous polyester resin, wherein the carnauba wax is present in an amount of from 3% to about 6% by weight of a total weight of the toner composition, and the mixing is accomplished in an extruder at a temperature of from about 80° C. to about 120° C., and grinding and classifying the toner composition to form a toner having an increase in glass transition temperature of from about 3.0° C. to about 6.0° C. higher than a toner without the carnauba wax.

In another embodiment, there is provided a toner comprising a resin comprising dispersed crystalline polyester resin and amorphous polyester resin, a colorant, and a wax comprising carnauba wax, wherein the toner has an increase in glass transition temperature of from about 3.0° C. to about 6.0° C. higher than a toner without the carnauba wax and wherein the toner has reduced plasticization.

DETAILED DESCRIPTION

In the following description, it is understood that other embodiments may be used and structural and operational changes may be made without departing from the scope of the present disclosure.

The present embodiments relate to the addition of a functional wax to toner compositions. Carnuaba wax may be classified as a functional wax due to available ester and acid groups. Specifically, the present embodiments relate to the addition of a carnauba wax, to help improve dispersion of resins used in the toner, and which may be incorporated with other toner components to increase the glass transition temperature Tg of the toner.

A common problem in electrophotographic machines often involves the fuser. For example, the high fuser roll temperature that occurs during use of the machines, and the toner build up on the fuser roll, leads to a shortened fuser roll life. One method to alleviate this wear and tear problem is to lower the fuser roll temperature. Thus, a key goal in toner designs is to come up with toner formulations that possess the desired characteristics of low melt to reduce fuser roll temperature during use and toner build up on the fuser.

Previously, it was discovered that when a large amount of the high molecular weight polymer or the crosslinked polymer is used as the resin, toner offset is avoided, but the fusing temperature is increased. However, when the molecular weight of the low molecular weight polymer is decreased, or when the amount of low molecular weight polymer is increased to decrease the fusing temperature, the temperature at which offset occurs, is also lowered.

As a method for solving the problems, various techniques have been proposed in that a crystalline resin is not used singly as the binder resin but an amorphous resin is used in combination. Thus, by adding a crystalline polyester to the amorphous polyester used in toner compositions, the desired characteristic of a lower melt toner are achieved. However, it is also discovered that the addition of crystalline polyester to amorphous polyester results in a suppression of the Tg Of the toner, also known as plasticization. Plasticization creates problems in toner storage, transport and use in the machines. A low Tg causes the toner to become sticky at higher temperatures. A toner with a Tg of 35° C. will become sticky around 35° C. A toner with a Tg of 40° C. will become sticky around 40° C. Therefore, it is desirable to keep the toner Tg higher, or less plasticized. Plasticization in turn gives the toner the propensity to block or stick together at elevated temperatures. The "blocking" results in problems at high temperatures where the toner particles begin to melt or sinter, and partially fusing together.

The addition of a wax comprising carnauba wax allows the toner composition to have the low melt benefits provided by the combination of crystalline polyester resin with amorphous polyester resin, and at the same time, minimizing the negative effects of plasticization or blocking. It was speculated that adding a wax comprising carnauba wax would help increase the Tg of the toner composition and thus reduce the plasticization effect. While use of wax in toners have been contemplated, as disclosed by commonly assigned U.S. Pat. Nos. 6,835,768, 7,179,575 and 7,160,661, U.S. Publication No. 2006/0228639, and U.S. Patent Publication No. 2007-0248902 A1, published Oct. 25, 2007, entitled "Toner Composition Having Dual Wax," which are all hereby incorporated by reference in their entirety, there has not been any known use of carnauba wax in toners to reduce or substantially eliminate the plasticization or blocking effect.

In adding a wax as described above, it was shown that the Tg was increased and that plasticization was reduced. In one instance, the addition of carnauba wax raised the Tg by 3.1° C. relative to an otherwise equivalent toner without carnauba wax.

In embodiments, there is provided a method for reducing toner plasticization in a toner. The method includes forming a toner composition by melt-mixing a resin, a colorant, and carnauba wax in which the resin comprises a mixture of crystalline polyester resin and amorphous polyester resin. The amorphous polyester may be in linear form or partially crosslinked. The mixing of the toner composition is accomplished in an extruder at a temperature of from about 80° C. to about 120° C. Subsequently, the toner composition is subjected to grinding and classifying to form the desired toner having a higher glass transition temperature than a toner without the carnauba wax. In further embodiments, the toner has an increase in glass transition temperature of from about 3.0° C. to about 6.0° C. higher, or about 3.0° C. higher, than a toner without carnauba wax, or from about 3.0° C. to about 6.0° C. higher than a toner without carnauba wax. In a specific embodiment, only carnauba wax is added and in an amount effective to raise the Tg at least 3.0° C. higher than a toner without the carnauba wax added.

In some embodiments, the ratio of crystalline polyester resin to amorphous polyester resin is from about 1:20 to about 1:4. The crystalline polyester resin may be a polyester derived from the reaction of a first compound selected from the group consisting of 1,4-butanediol, 1,6-hexandiol, and mixtures thereof, with a second compound selected from the group consisting of fumaric acid, oxalic acid, adipic acid, succinic acid, and mixtures thereof. The amorphous polyester resin may derived from the reaction of Bisphenol-A with a compound selected from the group consisting of fumaric acid, terephthalic acid, trimellitic acid, isophthalic acid, and mixtures thereof.

The carnauba wax may be added in an amount of from about 1% to about 6%, or from about 3% to about 6% by weight of a total weight of the toner composition. In further embodiments, the wax is present in an amount of from about 3% to about 5% by weight of a total weight of the toner composition. The colorant may be present in an amount of from about 1% to about 10%, or from about 5% to about 10%, by weight of a total weight of the toner composition. In one embodiment, the colorant comprises carbon black.

In further embodiments, there is provided a toner having a resin, a colorant, and a wax comprising carnauba wax, wherein the toner has an increase in glass transition temperature of from about 3.0° C. to about 6.0° C. higher than a toner without the carnauba wax and wherein the toner has reduced plasticization. The resin further comprises dispersed crystalline polyester resin and amorphous polyester resin. In one embodiment, the colorant is present in an amount of from about 5% to about 10% by weight of a total weight of the toner, the carnauba wax is present in an amount of from about 3% to about 6% by weight of a total weight of the toner, the crystalline polyester resin is present in an amount of from about 5% to about 20% by weight of a total weight of the toner, and the amorphous polyester resin is present in an amount of a remaining balance of the toner.

In general embodiments, the toner can comprise a resin, wax, colorant, and optional additives such as a charge control agent. Such toners are disclosed in, for example, U.S. Pat. No. 6,326,119; 6,365,316; 6,824,942 and 6,850,725, the disclosures of which are hereby incorporated by reference in their entireties.

Resin

The toner resin can be a partially crosslinked unsaturated resin such as unsaturated polyester prepared by crosslinking a linear unsaturated resin as shown in U.S. Pat. No. 6,359,105, which is hereby incorporated by reference. Also, the toner resin possesses, for example, a weight fraction of the microgel (gel content) in the resin mixture of from about 0.001 to about 50 weight percent, from about 1 to about 40 weight percent, or about 1 to about 30 weight percent.

The molecular weight distribution of the resin is thus bimodal having different ranges for the linear and the crosslinked portions of the binder. The number average molecular weight ($M_n$) of the linear portion as measured by gel permeation chromatography (GPC) is from, for example, about 1,000 to about 20,000, or from about 3,000 to about 10,000. The weight average molecular weight ($M_w$) of the linear portion is from, for example, about 2,000 to about 40,000, or from about 5,000 to about 20,000. The molecular weight of the gel portions is theoretically greater than 1,000,000. The molecular weight distribution ($M_w/M_n$) of the linear portion is from about 1.5 to about 6, or from about 1.8 to about 4. The onset glass transition temperature (Tg) of the linear portion as measured by differential scanning calorimetry (DSC) is from about 50° C. to about 70° C.

Moreover, the binder resin, especially containing crystalline polyesters, can provide a low melt toner with a minimum fix temperature of from about 100° C. to about 200° C., or from about 100° C. to about 160° C., or from about 110° C. to about 140° C.; provide the low melt toner with a wide fusing latitude to minimize or prevent offset of the toner onto the fuser roll; and maintain high toner pulverization efficiencies.

Examples of unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. An example of a suitable polyester is poly(propoxylated bisphenol A fumarate).

In embodiments, the toner binder resin comprises partially crosslinked amorphous polyester resin, unsaturated amorphous polyester resin to adjust rheological properties, and crystalline polyester. Tg range of from, for example, about 52° C. to about 64° C. It should be noted that saturated amorphous polyesters may be used in addition to, or in place of, the unsaturated amorphous polyester resin to adjust rheological properties.

Chemical initiators, such as, for example, organic peroxides or azo-compounds, can be used for the preparation of the crosslinked toner resins.

The crosslinked toner resins may be prepared by a reactive melt mixing process as shown in U.S. Pat. No. 6,359,105.

The binder resin is present in the toner in an amount of from about 40 to about 98 percent by weight, or from about 70 to about 98 percent by weight. The resin can be melt blended or mixed with a colorant, internal charge control agents, additives, pigment, pigment dispersants, flow additives, embrittling agents, and the like. The resultant product can then be micronized by known methods, such as milling or grinding, to form the desired toner particles.

Waxes

Waxes with, for example, a low molecular weight $M_w$ of from about 1,000 to about 10,000, such as polyethylene, polypropylene, and paraffin waxes, can he included in, or on the toner compositions as, for example, fusing release agents.

In further embodiments, the toner composition includes a carnauba wax in specific amounts to increase the Tg of the toner. A toner composition was made to include 20% crystalline polyester, 5% carbon black, 3% carnauba wax, and the balance percentage being amorphous resin. The toner was tested with a modulated DSC with a 3° C./min temperature ramp. First scan results demonstrated that the toner composition having the carnauba wax had a 3.1° C. higher Tg than the same toner without the carnauba wax.

Colorants

Various suitable colorants of any color can be present in the toners, including suitable colored pigments, dyes, and mixtures thereof including REGAL 330®; (Cabot), Acetylene Black, Lamp Black. Aniline Black; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BA YFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that can he selected are cyan, magenta, or yellow pigments or dyes, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Other colorants are magenta colorants of (Pigment Red) PR81:2, CI 45160:3. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Forum Yellow SE/GLN, CI Dispersed Yellow 33 2,5-dimethoxy-4-sulfonanilide phenylazo-4'-chloro-2,5-dimethoxy acetoacetanilides, and Permanent Yellow FGL, PY17, CI 2 1105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5.556,727, the disclosure of which is totally incorporated herein by reference.

The colorant, more specifically black, cyan, magenta and/or yellow colorant, is incorporated in an amount sufficient to impart the desired color to the toner. In general, pigment or dye is selected, for example, in an amount of from about 2 to about 60 percent by weight, or from about 2 to about 9 percent by weight for color toner, and about 3 to about 60 percent by weight for black toner.

Additives

Any suitable surface additives may be selected. Commonly used surface additives are silicon oxides and titanium oxides. These compounds enhance toner flow and charging performance. Additionally, fatty acid salts such as zinc stearate, zinc stearate laurate and calcium stearates can be used.

Calcium stearate and zinc stearate can be selected as an additive for the toners of the present invention in embodiments thereof, the calcium and zinc stearate primarily providing lubricating properties. Also, the calcium and zinc stearate can provide developer conductivity and tribo enhancement, both due to its lubricating nature. In addition, calcium and zinc stearate enables higher toner charge and charge stability by increasing the number of contacts between toner and carrier particles.

The toner composition can be prepared by a number of known methods including melt mixing the toner resin particles, and pigment particles or colorants, followed by mechanical pulverization and size classification. Charging and flow enhancing additives may also be dry blended onto the toner particle's surface. Other methods include those well known in the art such as melt dispersion, dispersion polymerization, suspension polymerization, extrusion, and emulsion/aggregation processes.

The resulting toner particles can then be formulated into a developer composition. The toner particles can be mixed with carrier particles to achieve a two-component developer composition.

EXAMPLES

The examples set forth herein below and are illustrative of different compositions and conditions that can he used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Making Toners

A toner comprising 20% crystalline polyester, 5% carbon black, 3% carnauba wax, and the balance a blend of partially crosslinked amorphous polyester resin and linear, unsaturated amorphous polyester were melt mixed in a Werner and Pfleiderer ZSK-25 extruder. The resulting mixture was formed into pellets using a water pelletizer and cooled. Another toner of the same composition with the exception of 3% more amorphous resin in place of the carnauba wax was made the same way. Samples of the extruded pellets were dried and ground in a Braun coffee grinder and submitted for modulated differential scanning calorimetry, or MDSC.

Testing of Toners With and Without Carnauba Wax

A toner having carnauba wax was tested against an equivalent toner without carnauba wax using modulated differential scanning calorimetry, or MDSC. The test toner included 20% crystalline polyester, 5% carbon black, 3% carnauba wax, and the amorphous polyester resin made up the balance. The comparative toner comprises the same composition as the test toner but without the addition of a wax comprising the carnauba wax. Instead, an additional amount of the amorphous polyester resin equal to and substituting for the carnauba wax is included in the comparative toner.

Approximately 10 mg of sample was weighed into an aluminum pan and analyzed using a TA Instruments Q1000 by the following temperature program: equilibrate at 0.00° C., modulate +/−0.48° C. every 60 seconds, isothermal for 5.00 min, and ramp 3.00° C./min to 140.00° C.

TABLE 1

Toner Tg with and without carnauba wax.
Modulated DSC with 3° C./min temperature ramp.

| Toner Formulation | Carnauba Wax | Crystalline Polyester | Tg (First Scan) |
|---|---|---|---|
| 1 | 0% | 20% | 36.1° C. |
| 2 | 3% | 20% | 39.2° C. |

As can be seen in Table 1, testing demonstrated that the addition of carnauba wax raised the Tg by 3.1° C. relative to the toner without carnauba wax.

All the patents and applications referred to herein are hereby specifically, and totally incorporated herein by reference in their entirety in the instant specification.

It will be appreciated that various of the above-disclosed and other features and functions, or alternatives thereof, may he desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

a resin comprising dispersed crystalline polyester resin and amorphous polyester resin, wherein the amorphous polyester resin comprises a partially crosslinked amorphous polyester resin;

a colorant; and a wax comprising from about 1% to about 6% by weight of carnauba wax based on the total weight of the toner composition, wherein the toner has reduced plasticization and an increase in glass transition temperature of from about 3.0° C. to about 6.0° C. higher as compared to a toner without the carnauba wax, wherein the toner without the carnauba wax comprises the same composition as said toner but without the addition of a wax comprising carnauba wax and with an additional amount of the amorphous polyester resin equal to and substituting for the carnauba wax.

2. The toner of claim 1, wherein a ratio of crystalline polyester resin to amorphous polyester resin is from about 1:20 to about 1:4.

3. The toner of claim 1, wherein the amorphous polyester resin further comprises a linear unsaturated amorphous polyester resin.

4. The toner of claim 1, wherein the carnauba wax is added in an amount of from about 3% to about 6% by weight of a total weight of the toner composition.

5. The toner of claim 1, wherein the colorant is present in an amount of from about 1% to about 10% by weight of a total weight of the toner composition.

6. The toner of claim 1, wherein the colorant comprises carbon black.

7. The toner of claim 1, wherein the crystalline polyester resin is a polyester derived from a reaction of a first compound selected from the group consisting of 1,4-butanediol, 1,6-hexandiol, and mixtures thereof, with a second compound selected from the group consisting of fumaric acid, oxalic acid, adipic acid, succinic acid, and mixtures thereof.

8. The toner of claim 1, wherein the amorphous polyester resin is derived from a reaction of Bisphenol-A with a compound selected from the group consisting of fumaric acid, terephthalic acid, trimellitic acid, isophthalic acid, and mixtures thereof.

9. A toner comprising:

a resin comprising dispersed crystalline polyester resin and amorphous polyester resin, wherein the amorphous polyester resin comprises a partially crosslinked amorphous polyester resin;

a colorant; and a wax comprising carnauba wax, wherein the toner has an increase in glass transition temperature of from about 3.0° C. to about 6.0° C. higher as compared to a toner without the carnauba wax, and further wherein the colorant is present in an amount of from about 1% to about 10% by weight of a total weight of the toner, the carnauba wax is present in an amount of from about 1% to about 6% by weight of a total weight of the toner, the crystalline polyester resin is present in an amount of from about 5% to about 20% by weight of a total weight of the toner, and the amorphous polyester resin is present in an amount of a remaining balance of the toner, wherein the toner without the camauba wax comprises the same composition as said toner but without the addition of a wax comprising carnauba wax and with an additional amount of the amorphous polyester resin equal to and substituting for the carnauba wax.

10. A toner having reduced plasticization obtained by a method comprising:

forming a toner composition by mixing a resin and a colorant, the resin comprising a mixture of crystalline polyester resin and amorphous polyester resin, wherein the amorphous polyester resin comprises a partially crosslinked amorphous polyester resin;

adding and mixing a wax into the toner composition to increase the dispersion of the crystalline polyester resin and the amorphous polyester resin, wherein the wax comprises from about 1% to about 6% by weight of camauba wax based on the total weight of the toner composition, and the mixing is accomplished in an extruder at a temperature of from about 80° C. to about 120° C.; and grinding and classifying the toner composition to form a toner having a higher glass transition temperature than a toner without the carnauba wax, wherein the toner without the carnauba wax comprises the same composition as said toner but without the addition of a wax comprising carnauba wax and with an additional amount of the amorphous polyester resin equal to and substituting for the carnauba wax.

11. The toner of claim 10 having an increase in glass transition temperature of from about 3.0° C. to about 6.0° C. higher than a toner without carnauba wax.

12. The toner of claim 10, wherein a ratio of crystalline polyester resin to amorphous polyester resin is from about 1:20 to about 1:4.

13. The toner of claim 10, wherein the amorphous polyester resin further comprises a linear, unsaturated amorphous polyester resin.

14. The toner of claim 10, wherein the carnauba wax is added in an amount of from about 3% to about 6% by weight of a total weight of the toner composition.

15. The toner of claim 10, wherein the colorant is present in an amount of from about 1% to about 10% by weight of a total weight of the toner composition.

16. The toner of claim 10, wherein the colorant comprises carbon black.

17. The toner of claim 10, wherein the crystalline polyester resin is a polyester derived from a reaction of a first compound selected from the group consisting of 1,4-butanediol, 1,6-hexandiol, and mixtures thereof, with a second compound selected from the group consisting of fumaric acid, oxalic acid, adipic acid, succinic acid, and mixtures thereof.

18. The toner of claim 10, wherein the amorphous polyester resin is derived from a reaction of Bisphenol-A with a compound selected from the group consisting of fumaric acid, terephthalic acid, trimellitic acid, isophthalic acid, and mixtures thereof.

* * * * *